United States Patent [19]

McReynolds, Jr.

[11] 4,028,542

[45] June 7, 1977

[54] FACETED PARABOLIC-TYPE REFLECTOR SYSTEM

[75] Inventor: Glen Harold McReynolds, Jr., Houston, Tex.

[73] Assignee: Esquire, Inc., New York, N.Y.

[22] Filed: Apr. 16, 1975

[21] Appl. No.: 568,725

Related U.S. Application Data

[63] Continuation-in-part of Ser. No. 505,140, Sept. 11, 1974, abandoned.

[52] U.S. Cl. ..... 240/41.36; 240/44.1; 240/103 A

[51] Int. Cl.² ..... F21V 7/09

[58] Field of Search ..... 240/41.35 R, 41.35 F, 240/41.36, 44.1, 103 R, 103 A; 113/116 J

[56] References Cited

UNITED STATES PATENTS

| | | | |
|---|---|---|---|
| 1,519,448 | 12/1924 | Gamain | 240/41.36 UX |
| 2,341,658 | 2/1944 | Salani | 240/41.36 |

FOREIGN PATENTS OR APPLICATIONS

| | | | |
|---|---|---|---|
| 370,039 | 8/1963 | Switzerland | 240/44.1 |
| 625,307 | 6/1949 | United Kingdom | 240/103 A |
| 347 | 2/1862 | United Kingdom | 240/103 R |
| 478,261 | 1/1938 | United Kingdom | 240/103 R |

*Primary Examiner*—George H. Miller, Jr.
*Attorney, Agent, or Firm*—Arnold, White & Durkee

[57] ABSTRACT

A luminaire including a segmented and faceted reflector of two sections describing a concave surface but approximately describing a plurality of paraboloid surfaces of revolution. With simple repositioning of the two reflector sections, a range of reflected beam widths may be achieved. The construction of the reflector sections provides economic fabrication without material reshaping or working and hence dulling of highly reflective material, the fabrication steps including V-notching and bending in two directions.

7 Claims, 11 Drawing Figures

FIG. 6
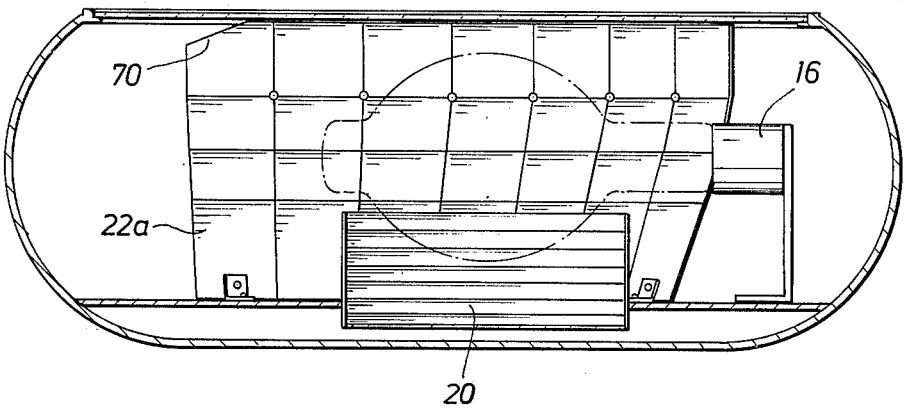
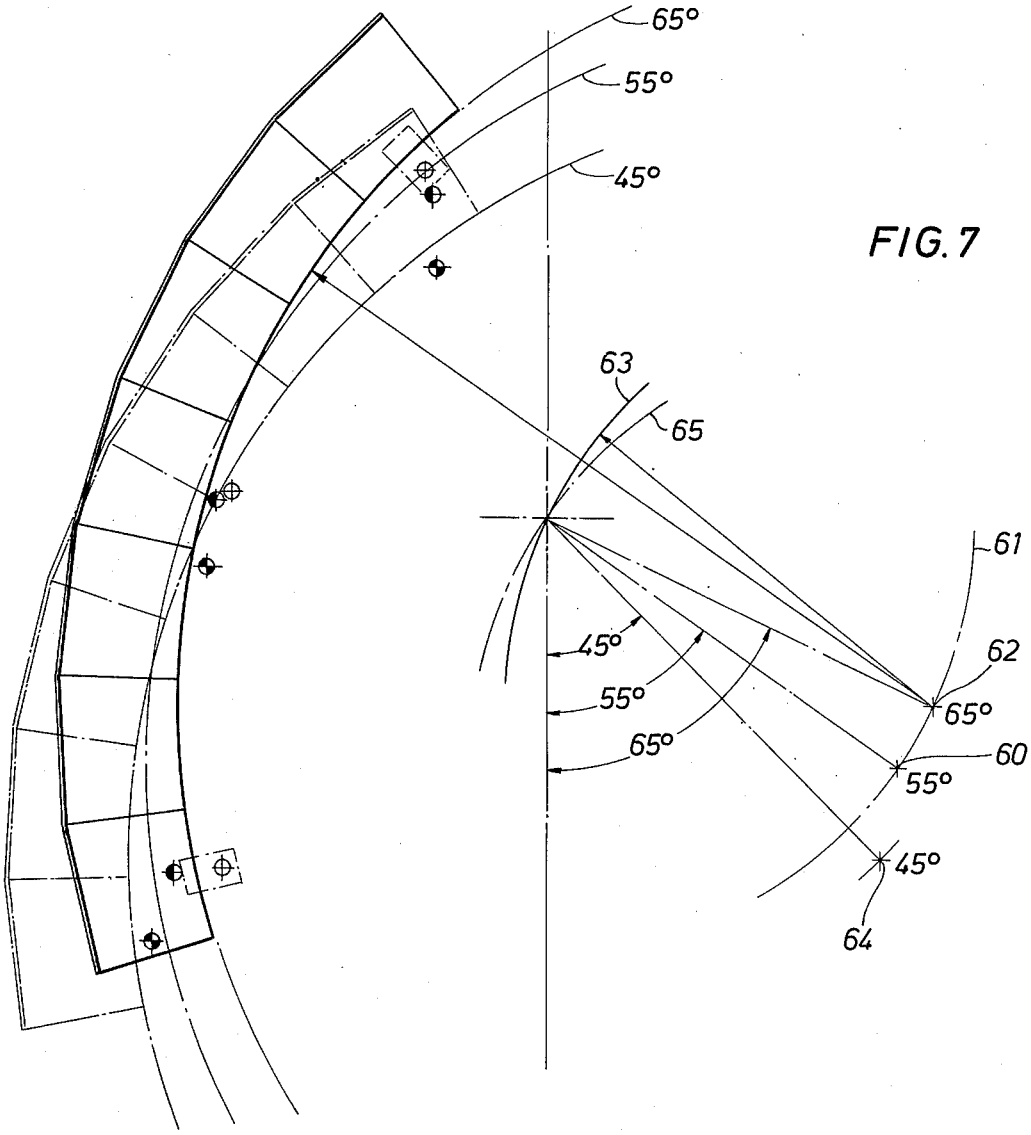
FIG. 7

FIG.8
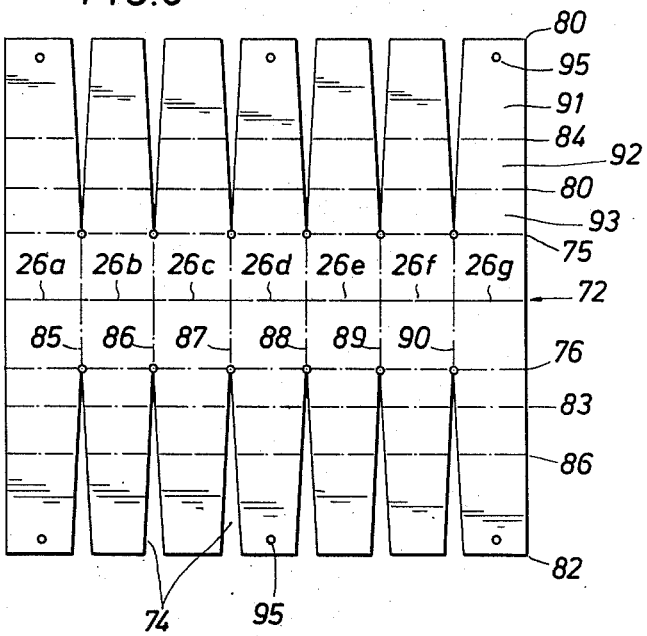
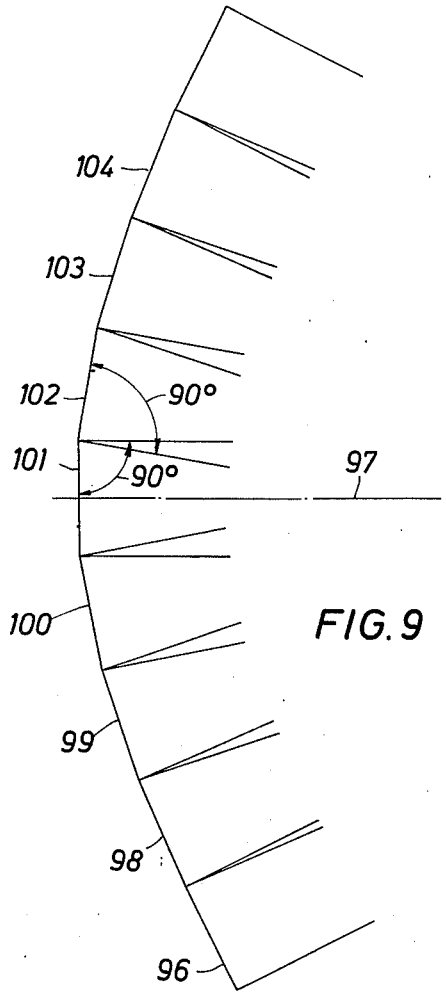
FIG. 9
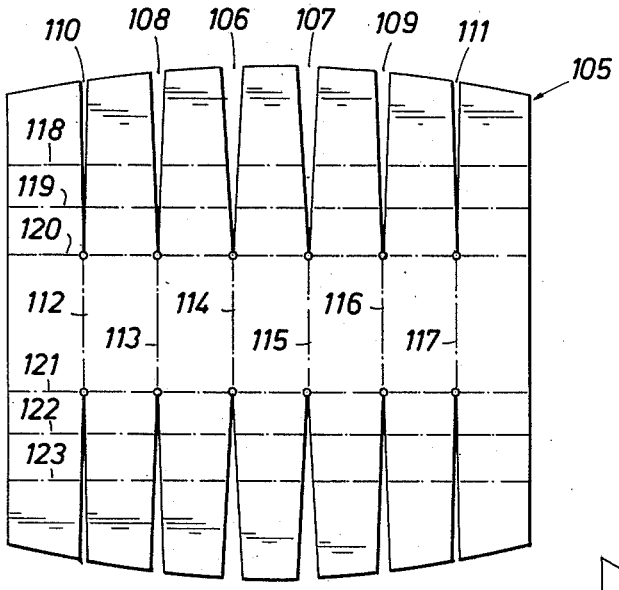
FIG. 10
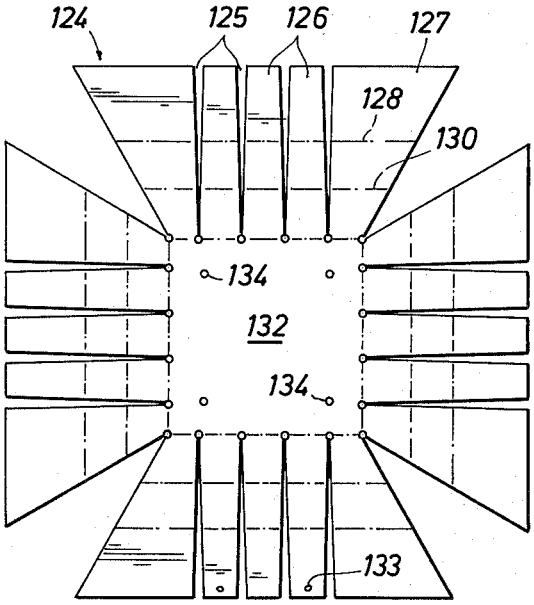
FIG. 11

FACETED PARABOLIC-TYPE REFLECTOR SYSTEM

This is a continuation-in-part of U.S. Pat. application Ser. No. 505,140, filed Sept. 11, 1974, now abandoned.

BACKGROUND OF THE INVENTION

Field of the Invention

This invention relates to luminaires or light reflecting systems and more specifically to the reflectors of such systems and their manufacture to produce versatile or adjustable reflectors approximating parabolic reflectors at relatively low cost.

Description of the Prior Art

Light reflectors are employed in luminaires to concentrate light in a generally desired direction. Reflectors are placed behind the source of light and are normally concave in shape so as to permit all light emanating from the light and reflector system to be either the direct light from the source or to be the primary reflective light. Primary reflective light is that light which is reflected only once from the source before the light is emitted from the luminaire.

One of the most efficient light reflectors known is in the shape of an elliptic paraboloid. The surface of an elliptic paraboloid may be formed by revolving a parabola about its axis. An important optical property of a parabola is that it will primarily reflect in parallel or collimated rays all light directed to it from a source located at its focus, these rays being parallel to the axis, in this case the "optical" axis of the parabola. In three dimensional terms, a paraboloid of revolution has the same desirable properties.

Although light reflectors have been successfully produced shaped like a paraboloid of revolution, several drawbacks are noted in such prior art reflectors. First, a reflector having a smooth concave shape is normally fabricated from molding or otherwise conforming a flat piece of metal. Again, normally the reflective surface of a reflector are made of specular Alzak, which becomes dull the more it is worked. Other reflector materials suffer this same disadvantage. Furthermore, forming a reflector surface is generally a much more expensive fabrication technique than bending and cutting. This is especially true for reflectors that are somewhat large, as for use with sodium vapor, metal halide and mercury vapor lamps.

Second, a paraboloid of revolution may concentrate the light too much for many applications. A highly concentrated beam is desirable for a search light application, but not for general illumination.

Third, a perfect paraboloid of revolution provides a relatively inflexible reflector. Although the light source may be moved from the focus, doing so may cause undesirable reflections. When the source is moved away from the focus along the axis, the beam is either caused to spread (non-parallel rays diverging) or caused to merge (non-parallel rays converging). When the source is mislocated off its axis, then the reflections from a relatively near surface is reflected at one angle while a relatively far surface is reflected at another, causing spreading in a non-uniform fashion. Such a repositioning does not refocus the beam so as to keep the beam desirably a parabolic-type reflection.

It is therefore a feature of this invention to provide an improved light reflector which is readily fabricated approximating a plurality of partial paraboloids of revolution.

It is another feature of this invention to provide an improved light reflector readily fabricated from flat reflective material comprising segments and facets, the reflector being conveniently adjustable to aproximate a plurality of parabolic surfaces.

It is still another feature of this invention to provide an improved light reflector having a cross section in the form of an arc which approximates a range of parabolas having different focus directions and hence, with a complementary reflector, achieving an overall capability of reflecting a change of beam widths, the reflections operating particularly efficiently with appreciable lighted lengths, rather than with theoretical, but non-existing, point sources.

SUMMARY OF THE INVENTION

A preferred luminaire in accordance with the present invention comprises a light reflector having two identical sections arranged to present two opposing or mirror sections, each section defining a cross sectional view of an arc of a circle approximating the shape of a parabola segment. The light source, typically a mercury vapor lamp, has its elongated lighted length along a center axis between the two and hence on the optical axis of the simulated parabola, the center of the source being approximately at the focus of the parabola. The opening or window of the luminaire is at one side of the source, or in other words, in a plane parallel with the lighted length and also parallel with the plane of the parabolic cross section of the reflector.

Each of the two sections is segmented so that the straight line approximations of the cross section of the segments fall along the arc.

The sections of the reflectors also define a concave surface about the source, such surface area approximating a partial paraboloid surface of revolution. Actually, each segment is bent at a plurality of places to form multiple facets on each segment, the facets together approximating the desirable concave shape. The bends are made parallel to the plane of the opening. However, they are not bent at the same angle nor do they establish facets of uniform dimension. They do provide overlapping forward image projections from the source through the opening.

By securing the reflector sections to the luminaire so that the open ends are further or closer together, the preselected and preformed arc still closely resembles a parabolic shape. However, now the angle of reflection is modified. As will become more apparent below, a perfect parabola would not permit such adjustment without separating or causing interference with the two reflector sections near the vertex to such an extent to appreciably reduce the amount of reflector surface. Also, the arc approximation permits refocusing without relating the light source from the focus point. As may be appreciated, reflectors are relatively easy to relocate, but moving the location of a light source within a luminaire is relatively complex. The light source may be kept at the same location, or a suitable focus for all positions of the reflector sections if there is ample room in the luminaire. By such repositioning of the reflectors and by angling the reflectors so as to keep them on the approximate corresponding surface of each new paraboloid revolution, the light from the luminaire may be efficiently projected over a range of beam widths. That is, no new set of reflectors is needed for each desired beam width. Moreover, because the surface is approximated by facets, the primary reflected beam width from the luminaire is spread, i.e., not as focal, as from a continuous parabolic surface of the same dimension.

The sections are fabricated from elongated strips. A plurality of V-notches are made at the locations between the segments to about three quarters of their width, or to the place where the first facet bend is made. The bends are then crimped to their predetermined angle to form the facets in the segments. As the bends are made, the V-notches are drawn together so that there is no appreciable opening between the segments in the completely formed reflector section.

Since the reflectors are made by cutting and bending, but not by molding or otherwise working the material, the highly reflective material does not become dulled.

BRIEF DESCRIPTION OF THE DRAWINGS

So that the manner in which the above-recited features, and various advantages and objects of the invention which will become apparent, can be understood in detail, more particular description of the invention briefly summarized above may be had by reference to the embodiments thereof which are illustrated in the appended drawings, which drawings form a part of this specification. It is to be noted, however, that the appended drawings illustrate only typical embodiments of the invention are are therefore not to be considered limiting of its scope, for the invention may admit to other equally effective embodiments.

In the Drawings:

FIG. 6 is a view of the luminaire shown in FIG. 5 taken at section 6—6.

FIG. 7 is a graphical representation of positioning reflectors in accordance with the present invention so as to achieve varying projected beam widths.

FIG. 8 is a graphic illustration of the calculations utilized for the development of the sheet from which a luminaire reflector is formed, which reflector is representative of the present invention.

FIG. 9 is a plan view illustration of a sheet of reflective material that has been formed, showing in broken lines the bends that are formed thereon to define another luminaire, which has a more complete generally hyperbolic configuration as compared with the configuration shown in FIGS. 2, 4 and 5.

FIG. 10 is a plan view illustration of a sheet of reflective material that has been formed, showing in broken lines the bends that are formed thereon to define another luminaire of more complete generally hyperbolic configuration.

FIG. 11 is a plan view illustration of a sheet of reflective material that has been formed, which may be bent along the broken lines shown thereon in order to form a luminaire having four sides and representing a further embodiment of the present invention.

DESCRIPTION OF PREFERRED EMBODIMENTS

Figure 1:
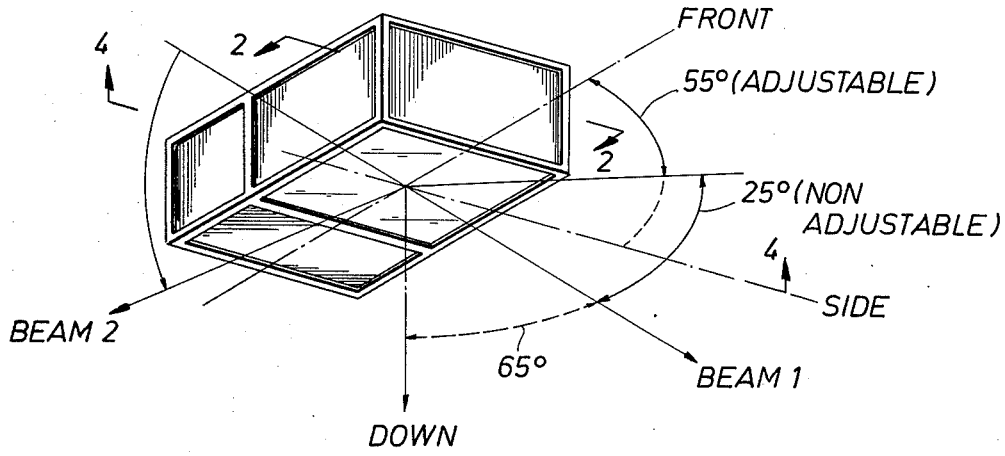
FIG. 1 is a pictorial view of a preferred luminaire employing reflectors in accordance with the present invention.

Now referring to the drawings and first to FIG. 1 a luminaire 10 in accordance with the present invention is shown having an opening 12 or window on one side thereof for directing light in a predetermined direction. In this case, the luminaire is a rectangular parallel piped. The light emanating through opening 12 may project downward at an angle typically about 65° to the vertical and may have a beam spread of typically about 55°.

Figure 4:
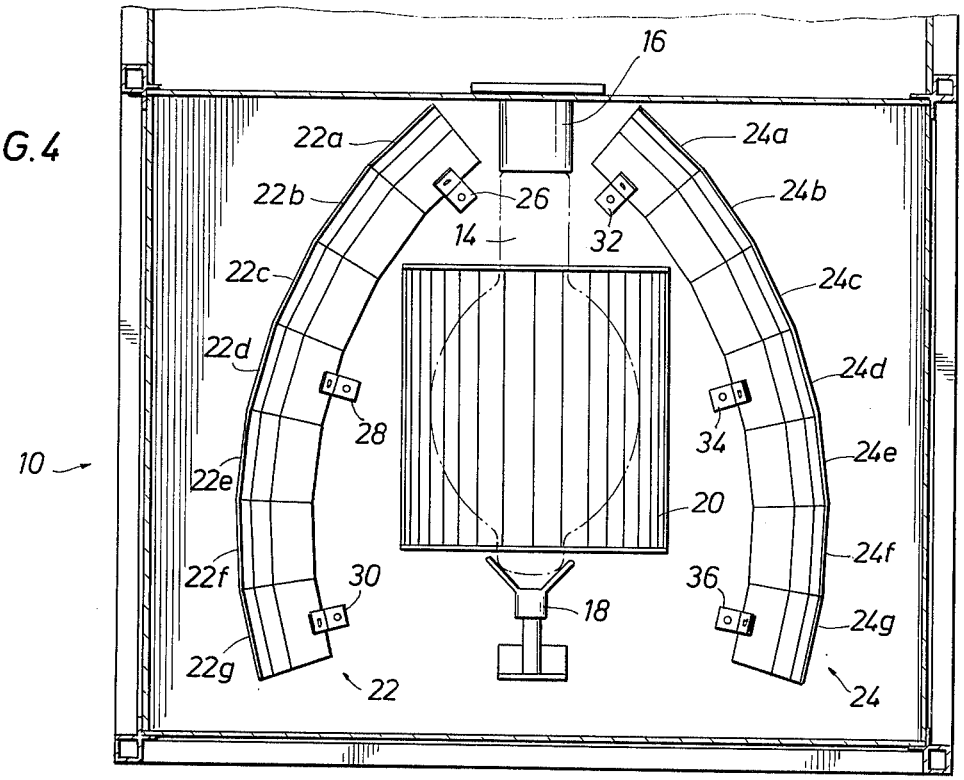
FIG. 4 is a view of the luminaire shown in FIG. 1 taken at section 4—4.

Now referring to FIG. 4, a bottom view of the luminaire opening is shown. As may be seen, the luminaire accepts a lamp source 14 in socket 16 to be supported at its lower end by support 18. Typically, the lamp may be a mercury vapor lamp having a lighted length at its center portion of about 3 inches. Behind the lamp is a generally concave reflector 20 fabricated from a flat sheet of reflective material by successively bending the sheet to form elongated segments.

On either side of lamp 14 are side reflectors 22 and 24 in accordance with the present invention. These two reflectors are preferably identical and are arranged within the luminaire so as to be complementary or mirror images of each other.

In a plane parallel to the plane of the opening, reflector sections 22 and 24 form a partial arc of a circle but are positioned so as to approximate a partial parabola having its focus at the center of the lighted length of lamp 14. Reflector section 22 is comprised of a plurality of flat sections 22*a* – 22*g*. Sections are made by bending the reflector perpendicular to the edge secured to the back of the luminaire at uniform distances along the length of the reflector. In the illustrated embodiment seven segments are made by six bends. The segments are uniformly dimensioned so that in one embodiment the segments widths are each three inches. Section 22 is secured to a plane parallel with the plane of the opening and behind lamp 14 by brackets 24, 28 and 30. A screw in the back surface of the luminaire and in the reflector section secures the bracket, and hence the section, in place.

In like manner, brackets 32, 34 and 36 and accompanying screws secure reflector section 24 to the luminaire.

To achieve a beam spread, each reflector section 22 and 24 opens and partially surrounds lamp 14. Each of these sections approximates an arc of a circle, the curvilinear surface of the reflector approximating a concave reflector having the properties hereafter discussed. The arcs are arranged within the reflector to approximate a parabola and the concave surfaces thereof approximate a paraboloid of revolution.

Furthermore, it may be seen that the reflectors are bent at a plurality of locations parallel to the plane of the opening so as to form a plurality of facets in each segment. In the illustrated embodiment, three bends are shown to create four facets in each segment. The facets lie on a surface cord approximated by the overall segmented and faceted reflector.

Figure 2:
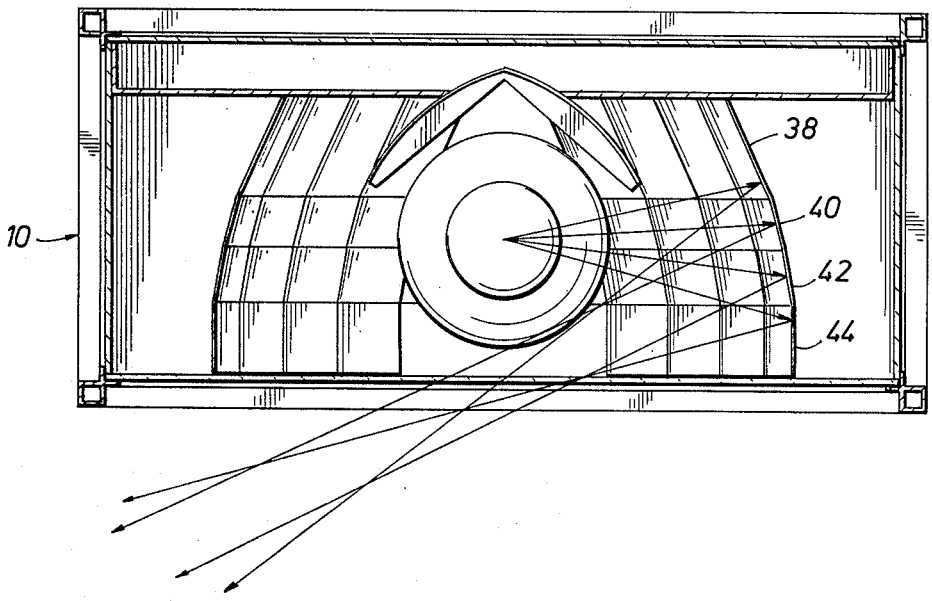
FIG. 2 is a view of the luminaire shown in FIG. 1 taken at section 2—2.

As best shown in FIG. 2, the four facets of each segment are not of uniform dimension. Each does have a surface which primarily reflects light from the source through the opening of the luminaire. However, since each surface is angled slightly differently with respect to the lamp, the reflections are at varying angles. Furthermore, since there is a dimension to each surface, there is a beam spread in the reflection angle from each surface.

The first facet 38, the longest, is set at the least angle with respect to the plane to which the reflector is secured and therefore projects light at the shallowest angle of any of the reflector facets. Actually, not all of this reflector facet projects light from the luminaire, since some of the facet which is closest to the mounting surface does not clear the exit pupil upon reflection.

Progressively, facets 40, 42 and 44 are at larger angles with respect to the mounting surface and therefore reflect light at larger and larger angles. By dimensioning faces 38, 40, 42 and 44 and by carefully bending the reflector therebetween at varying angles, it is possible to get a fairly uniform or even spread of light over a specified range. It may be seen that by adjusting the angle of each facet with respect to the mounting surface and by changing the reflection dimension, the amount of light at a particular angle may be varied.

Figure 3:
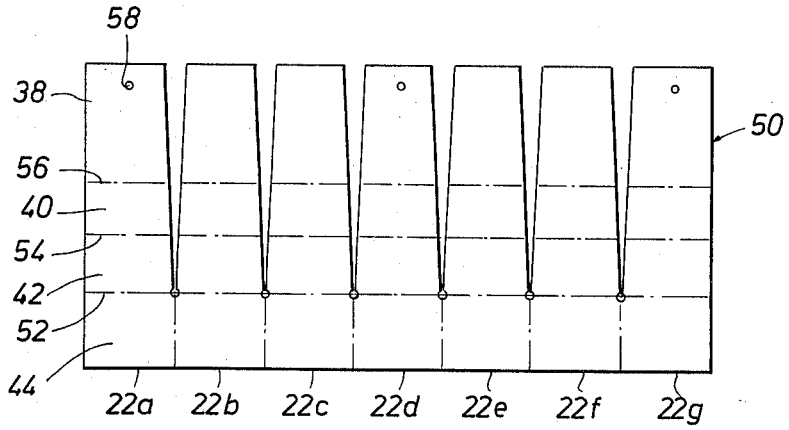
FIG. 3 is a plan view of an elongate reflective strip for making a reflector segment of a preferred embodiment of the present invention.

Now referring to FIG. 3, a reflected reflective strip 50 is shown preliminary to fabricating a reflector section as described above. In this example, the strip is approximately 21 inches long and nearly 10 inches wide. To form the sections, bend positions are marked between segments 22*a* – 22*g*. The first bend 52 is at about one-guarter of the distance from one elongate edge of strip 50 to the opposite elongate edge and is made parallel to these edges. At this location, six V-notches are cut to the opposite elongate edge of the strip, one on each segment border. The angle of this V is determined by the overall effect of bending the reflector in accordance with the description below.

Bends 54 and 56 are located to provide the facets described with respect to FIG. 2. In one embodiment, the length of the respective facets are 3 51/64 inches long, 1¾ inches long, 1 23/32 inches long and 2½ inches long respectively. The longest facet is the one at the openings of the V-notches.

Convenient bend angles have been found to be 11° separating facets 38 and 40, a 5° bend separating facets 40 and 42, and a 10° bend separating facets 42 and 44.

The bend between the segments are then next made, in one embodiment to be approximately each 10° bends. When the bends are made in both directions as above described, the V-notches are very nearly closed so that each segment forms a nearly contiguous surface with the adjoining segment surface. A notch dimensioned 17/32 of an inch at its opening has been found sufficient to correspond with the other dimensions which have been given.

Finally, holes 58 are made approximately in the center of segments 22*a*, 22*d* and 22*g* approximately three-eigths of an inch from the elongate edge nearest them. These are the mounting holes for securing the brackets to the reflector section.

Now referring to FIG. 7, an illustration of alternate positioning of a reflector section in accordance with the present invention is shown. If a general beam width angle of 55° is desired, the arc should be positioned along the line marked 55° . Note that the radius of this arc from point 60 passes through the center of the lighted length of the light source. Note also that a parabola to give the 55° beam width may be approximated by a circle having a radius approximately twice the distance between the focus and the parabola.

To achieve a 65° beam width, the same circle dimension may be used to approximate the new "65°" parabola. However, the circle arc must be relocated.

To locate point 62, an arc 61 is drawn through point 60, the center of the arc being the focus location for the 55° parabola. At the 65° location (65° from the axis as shown), an arc 63 may be drawn using the same radius and a concentric arc may be drawn therewith using the radius of the reflector arc. To achieve the 65° beam reflection, the source may be placed anywhere along arc 63. One such place is the focus position for the 55° arc location; therefore, the source does not have to be moved.

A 45° beam width may be similarly arrived at. However, if the dimensions of the luminaire arc such that it is not possible to provide a 45° beam width throught the procedure just described, then it is possible to make the half radius distance a little bit greater than previous. This is shown by the location of point 64 for the radius describing the "45°" arc. In all events, the center of the lighted length of the light source is preferably located at the focus of the approximated parabola. It may also be seen that the same reflector section arc in each case, satisfactorily approximates the respective parabolas. Hence, only one reflector section is necessary.

In actuality, the true axis of the parabolic section is slightly rotated from the axis for the 55° parabola, but since an arc is used to approximate the parabola no real harm is done so long as the source is on the respective "half-arc", 63 for the 65° beam width and arc 65 for the 45° beam width. Since both these half-arcs may be drawn through the focus for the 55° "parabola" then no repositioning of the source is required, only the reflector sections. Further, note that the rear of the reflector (near the vertex of the simulated parabolas) are kept pretty close to the optical axis, thereby providing no less in reflective surface behind the bulb as would be the case in repositioning a true parabola.

Figure 5:
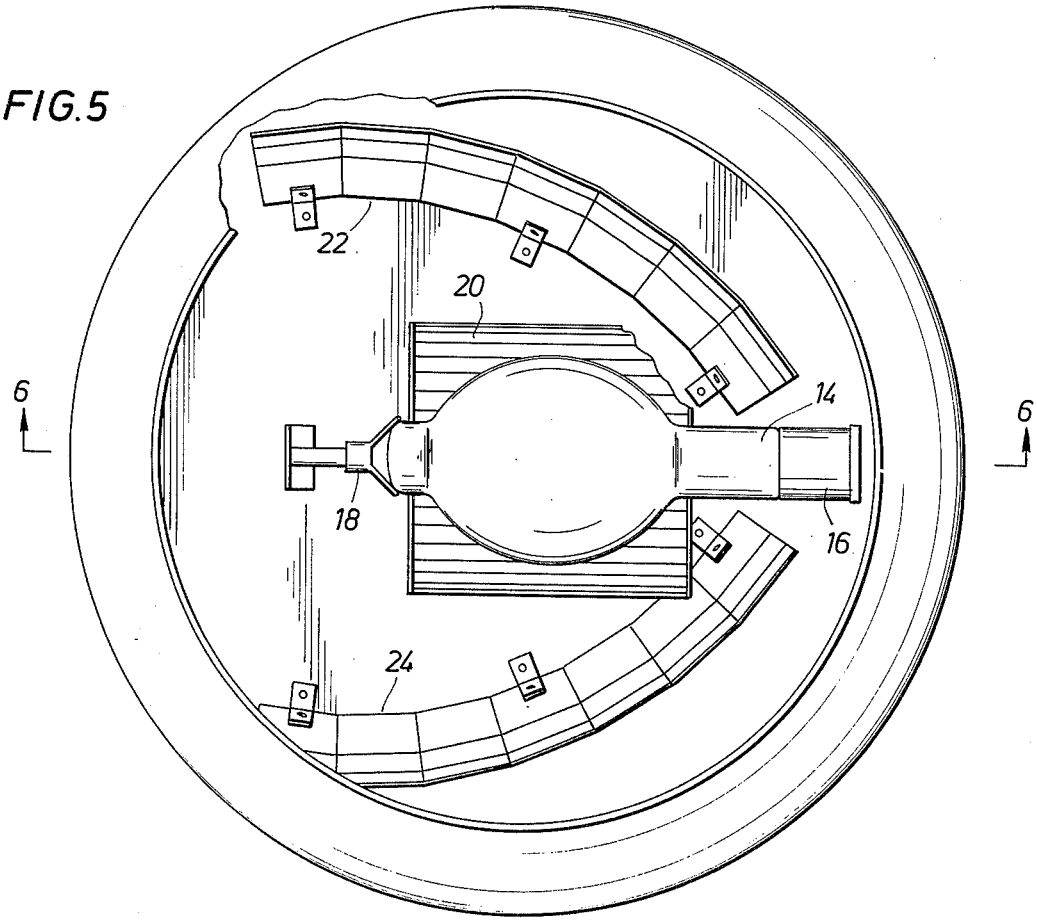
FIG. 5 is a plan view of another luminaire employing reflectors in accordance with the present invention.

Now referring to FIG. 5, an alternate luminaire is shown to the one illustrated in FIG. 1. In this case, the luminaire has a circular opening; however, the reflector sections 22 and 24 are still similarly situated with respect to source 14. A cross sectional view of this structure is shown in FIG. 6. It may be noted that in this case section 22*a* of reflector 22 has had one corner angled at cut 70 so as to permit the mounting of the reflector within the luminaire. Since this part of the reflector is within the limits of the reflector housing, the depreciation of the amount of light primarily reflected is very minimal.

It may be desirable to provide a luminaire reflector having more complete hyperbolic curvature as compared with the luminaire configurations illustrated in FIGS. 2, 4 and 5. This is conveniently accomplished simply by providing a substantially flat sheet of reflective stock material and forming it to configuration illustrated in FIG. 8. As shown in FIG. 8, the top and bottom halves of the reflector sheet may be substantially mirror images of one another and may be folded along the various broken lines shown in order to form a hyperbolic luminaire reflector. The sheet stock 72 is cut away to define a number of V-notches 74 similar to those illustrated in FIG. 3 and each half of the sheet stock is bent in substantially the same manner as that described above in connection with FIG. 3.

To form the various sections, bend positions are marked between segments 26*a* and 26*g* and first bends may be formed along the broken lines shown at 74 and 76 approximately one quarter of the distance from the centerline 78 to the outside edges 80 and 82 respectively. Bends may then be formed along broken lines 80, 82, 84 and 86 to define the plurality of facets that are desired for full formation of the hyperbolic reflector. The sheet material will also be bent along lines 85–90 causing the edges of the V-notches to move into substantial engagement along the length thereof and causing the finished reflector to be a substantially continuous element defined by the contiguous facet surfaces. The angle of each of the V-notches will be determined by the overall effect of bending the reflector stock so as to form a completed luminaire reflector of desired hyperbolic configuration. On each side of the centerline 78, the length of the respective facets from the outside surfaces of the sheet stock toward the center line may, for example, be three-51/64 inches long, one-¾ inches long, 1-23/32 inches long and two-½ inches long respectively. The longest facet, like in FIG. 3 will be the one located at the openings of the V-notches. Also, like in FIG. 3, as a further example, convenient bend angles may be in the order of 11° separating facets 91 and 92, a 5° bend separating facets 92 and 93 and a 10° bend along line 74 separating facets 93 and 94.

Although the V-notches 74 are shown in FIG. 8 and other figures herein to be of V-shaped configuration, it is not intended to limit the present invention specifically to such configuration, it being obvious that notches of other than V-shaped configuration may be employed, depending upon the desired finish configuration of the luminaire reflector to be formed. For example, the angular relationship of the edges of the notches along each of the various facets may be of different angular relationship if desired, this angular relationship being determined by the desired configuration of the luminaire reflector to be formed. Holes 95 may be formed in various ones of the outer facets such as shown in FIG. 8, enabling a finished reflector to be supported by mounting brackets such as shown at 28 and 30 in FIG. 4 or by any other suitable means of support.

In forming a luminaire reflector from flat sheet reflector stock, it has been determined that a more close approximation of hyperbolic configuration will be formed if the angular V-notches in the sheet material are defined by edge surface lines that are substantially perpendicular to each of the line segments defining the hyperbola of the luminaire hyperbolic reflector configuration. This is illustrated graphically in FIG. 9, where a partial hyperbola 96 is shown to be formed about a centerline 97 with a number of line segments 98 through 104 being superposed as nearly as possible on the hyperbola. Lines are then formed at each extremity of each of the segments, the lines being disposed in normal relation to the respective segment. Perpendicular lines formed at the ends of each of the segments cooperate to define a slot which may be substantially V-shaped such as shown in FIGS. 8 and 10.

If the arc of a circle were defined by line 96, each of the V-shaped slots defined by lines at each end of the segments 98 through 104 would be of equal included angle. Since line 96 is a hyperbola with greater curvature adjacent the center line than at each extremity thereof, the included angles defined by the cooperating lines at each end of the segment will be greater near the center line and will be of consecutively decreasing included angle away from the center line. As the appropriate bends are formed to define the hyperbolic configuration of the luminaire reflector, the angles of the slots will close and the edges of each of the facets will move into substantial coincidence, thereby causing all of the facets of the completed reflector to substantially lie along the hyperbolic arc of reflector generation.

This feature is evident from FIG. 10, where reflective sheet stock such as shown generally at 105 is shown to define a plurality of generally V-shaped slots on each side thereof. Considering the upper portion of reflector 105 for purposes of explanation, central slots 106 and 107 are of substantially identical included angle. V-shaped slots 108 and 109 are also of substantially identical included angle, but are of smaller included angle than the included angle of slots 106 and 107. Likewise, slots 110 and 111 are of identical included angle but are of smaller angle dimension as compared with slots 108 and 109. The various V-shaped slots formed in the sheet stock 105 will close bringing the edges of the finger like forms that define the various facets of the reflector surface into substantial engagement as the sheet stock is bent in such manner as to form the parabolic shape of the reflector. Referring to FIG. 8, subsequent bending of the elongated finger-like portions of the sheet stock 105 along broken lines 118 through 123 will form the various facets of the reflector surface. Each of the facets will lie as nearly as possible along an imaginary parabolic surface.

With reference now to FIG. 11, it may be desirable to provide a light reflector having a plurality of parabolically shaped sides, each of the sides being defined by a plurality of facets that are each formed and positioned so as to define a parabolic reflector. Such reflector configuration may conveniently take the form illustrated generally at 124 in FIG. 11, where a generally rectangular sheet of reflector stock may be formed to define a plurality of V-shaped notches 125 that separate portions of the sheet stock into elongated finger-like elements 126. At the corner portions of the reflector stock generally triangular or trapezoidal reflector form may be defined which may be bent along lines 128 and 130 if desired to form corner portions of a reflector or which may be bent in other angular form if desired to define corner reflector portions of desired configuration. As much of the corner reflector portions 127 as desired may be removed by cutting away if desired to form a reflector of any other desirable configuration. Upon bending of the various finger like forms along the broken lines, such as illustrated at 128 and 130, facets will be formed on each of the reflector fingers, which facets will cooperate in the finished form of the reflector to define a reflector portion of parabolic configuration. As shown in FIG. 11 there will be defined four parabolic reflecting edge portions that are each connected to a centrally located generally planar portion 132. Holes 133 may be formed in various ones of the finger elements in order to provide for connection of the reflector finger portions to support devices if desired. Alternatively, the light source may be placed in substantially centrally located manner relative to the central planar portion 132 of the reflector and apertures 134 may be formed in the planar surface in order to provide connection of the reflector to any suitable support structure by means of screws or other support devices.

Although particular embodiments of the invention have been shown, it will be understood that the invention is not limited thereto, since many modifications may be made and will become apparent to those skilled in the art. For example, a luminaire may be opened at more than one face so as to project the light within a fuller range of openings from the source. Also, notice that the exact positioning of the reflector within the luminaire is not critical. Therefore, a sodium vapor lamp with a typical lighted length of eight inches may be used with the reflector described herein as well as the mercury vapor lamp with much shorter typical lighted length of three inches. If the center of the lighted length is not exactly on the focus, then a little bit more in the way of spreading or focusing of the reflections will result, but the overall beam spread will not be appreciably affected. Also, the principles described herein are applicable to light systems having multiple light sources.

What is claimed is:

1. A luminaire adaptable for securing therein a light source through which an optical axis passes, and having an opening through which light from the source is emitted, including a reflector having a plurality of substantially contiguous planar segments, said segments forming a part of a circular arc in a plane behind the source and parallel to the opening to one side of the axis, said arc approximating a parabolic shape with the center of the source at its focus, said reflector parabolically positionable with respect to said source so as to change the reflected beam angle through the opening.

2. A luminaire as set forth in claim 1, and including another substantially identical reflector arranged as the mirror image of said first reflector, said other reflector positioned to describe an arc in the plane behind the source to the opposite side of the axis from said reflector.

3. A luminaire as set forth in claim 1, wherein said reflector includes a pair of generally identical sides, each of said being defined by a plurality of elongated elements that are bent along lines in such manner to define a plurality of facets and in such manner that adjacent edges of said elongated elements are disposed in substantially touching relation.

4. A luminaire as set forth in claim 1, wherein said reflector includes a plurality of generally identical sides, each of said sides being defined by a plurality of elongated elements that are bent along lines in such manner as to define a plurality of facets and in such manner that adjacent edges of said elongated elements are disposed in substantially touching relation.

5. A luminaire as set forth in claim 1, wherein the surface of said reflector approximate a portion of a paraboloid of revolution, said reflector curving forward toward the opening of the luminaire to partially surround the source, each of said segments being faceted by bends therein parallel to the plane of the opening.

6. A luminaire as set forth in claim 5, wherein the bends are spaced non-uniformly and at varying angles so as to provide even overlapping forward image projections of said source through said opening.

7. A reflector for a luminaire adaptable for securing therein a light source through which an optical axis passes, and having an opening through which light from the source is emitted, said reflector including:

a plurality of groups of generally planar facets, said groups each being defined by a plurality of substantially contiguous planar segments, said segments forming parts of circular arcs in planes behind the source parallel with the opening to one side of the axis, said arcs approximating parabolic shape with the center of the source.

* * * * *

UNITED STATES PATENT OFFICE

CERTIFICATE OF CORRECTION

Patent No. 4,028,542 Dated June 7, 1977

Inventor(s) Glen Harold McReynolds, Jr.

It is certified that error appears in the above-identified patent and that said Letters Patent are hereby corrected as shown below:

Col. 4, lines 7-8, "parallel piped." should be --parallelepiped.--.

Col. 6, line 12, "arc" should be --are--; line 27, before "63" should be inserted --arc--; line 35, "less" should be --loss--.

Col. 9, line 6, after "with" should be inserted --the--; line 35, after "said" should be inserted --sides--.

Col. 10, line 13, "approximate" should be --approximates--.

Signed and Sealed this

*Fifteenth* Day of *November 1977*

[SEAL]

*Attest:*

RUTH C. MASON
*Attesting Officer*

LUTRELLE F. PARKER
*Acting Commissioner of Patents and Trademarks*